US006276238B1

(12) United States Patent
Junck et al.

(10) Patent No.: US 6,276,238 B1
(45) Date of Patent: Aug. 21, 2001

(54) OPEN TOP ROTATING VISE

(76) Inventors: Todd A. Junck, 6 Shawn Dr., Swansea, IL (US) 62226; Richard S. Mongillo, 2422 Bristow, Charlack, MO (US) 63114

( * ) Notice: Subject to any disclaimer, the term of this patent is extended or adjusted under 35 U.S.C. 154(b) by 0 days.

(21) Appl. No.: 09/628,881

(22) Filed: Jul. 31, 2000

(51) Int. Cl.[7] ..... B25B 13/50
(52) U.S. Cl. ..... 81/57.34; 81/57.35
(58) Field of Search ..... 81/57.33–57.35, 81/57.15, 57.16, 57.19, 57.21, 57.24, 57.25

(56) References Cited

U.S. PATENT DOCUMENTS 4,345,493 8/1982 Rassieur .
4,870,738 10/1989 Rassieur .
5,727,432 3/1998 Burns et al. .

*Primary Examiner*—D. S. Meislin
(74) *Attorney, Agent, or Firm*—Polster, Lieder, Woodruff & Lucchesi, L.C.

(57) ABSTRACT

An open top rotating vise for use in breaking joints in a drillstring has a cradle with two side plates and two end plates secured to one another and semi-circular bearing surfaces carried by and extending outboard from the side plates. A stand with side frame members extending parallel to the cradle side plates has anti-friction rollers carried by and extending inboardly from the side frame members. The rollers are arranged on a radius concentric with the radius of the cradle semi-circular bearing surface and positioned to engage the cradle bearing surface. Oppositely facing jaw members are carried by the cradle intermediate the cradle side plates.

6 Claims, 10 Drawing Sheets

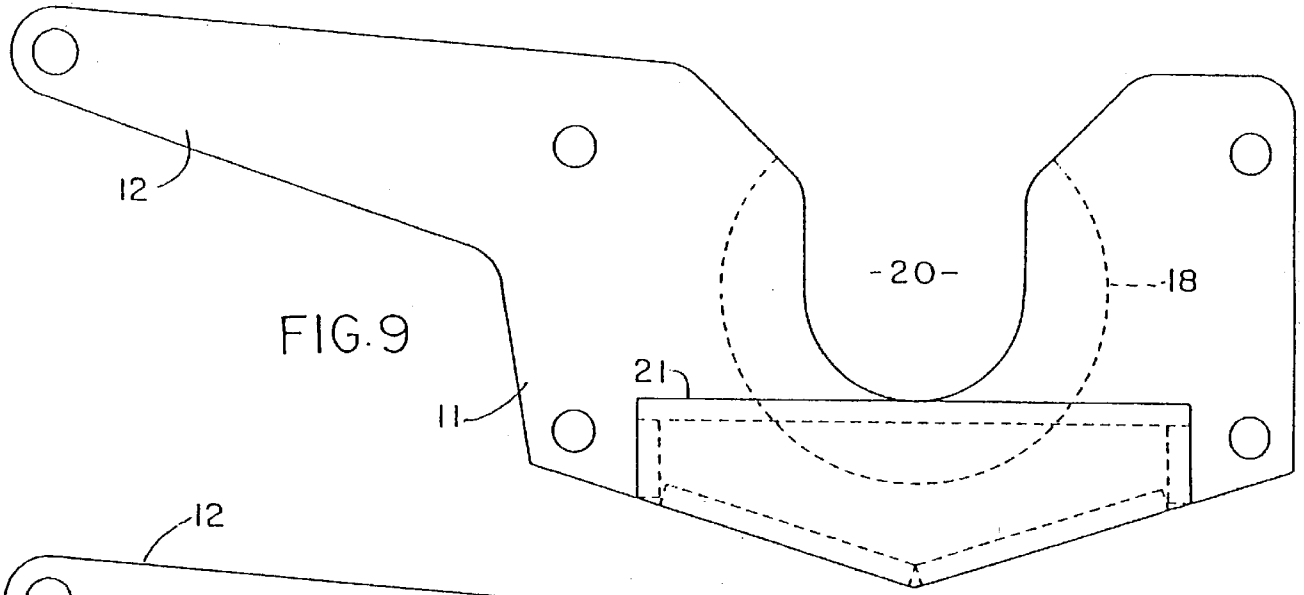
FIG.9
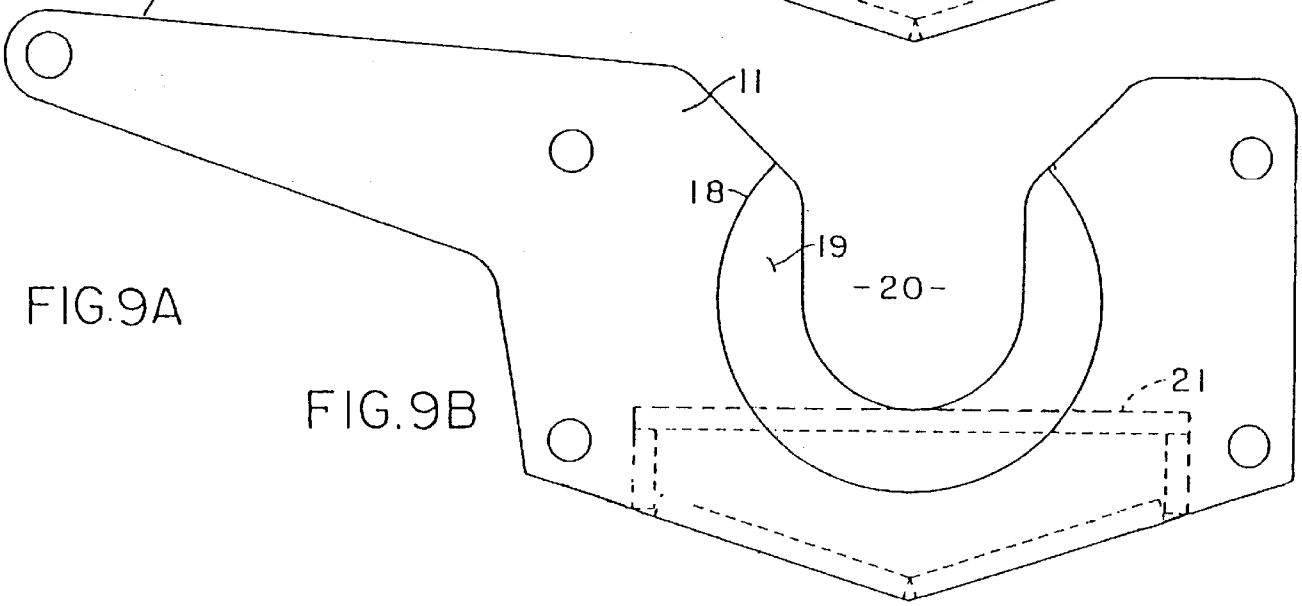
FIG.9B
FIG.9A
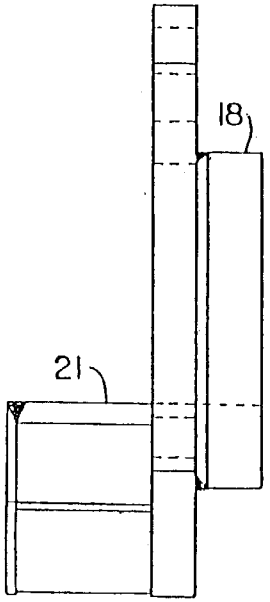

OPEN TOP ROTATING VISE

CROSS REFERENCE TO RELATED APPLICATIONS

None

STATEMENT REGARDING FEDERALLY SPONSORED RESEARCH OR DEVELOPMENT

Not Applicable.

BACKGROUND OF THE INVENTION

Drill rods or pipes come in sections that are joined by male threads, tapered convergently, and female sockets, threaded and tapered internally complementarily to the male threads. The drill strings are rotated in a direction that tends to tighten the joints. That, plus the fact that the joints are liable to get gritty material between the threads, makes breaking the joints difficult. Various power mechanisms have been proposed and used (e.g., U.S. Pat. Nos. 4,345,493, 5,727,432). Where non-rotating vises have been employed, they have held the rod while a pipe wrench or the like has been used to turn the section that is not gripped by the vise. The wrench has been turned either manually or by some power mechanism. The pipe wrench type joint breakers have the disadvantage that the gripping surface is limited, putting extreme pressure in a limited area, and may not provide sufficient gripping force. Another approach to turning the free section has been to provide jaws sliding in a cradle rotated on a radius concentric with the radius of a pipe or rod clamped between the jaws. However, this construction has heretofore been subject to wear, with metal-to-metal contact, and a tendency to distortion, which leads to misalignment between the sections of the string.

One of the objects of this invention is to provide an improved open top rotating vise, in which there is substantially no wear or distortion, and in which the rotation of the rotating vice is facilitated.

Other objects will become apparent to those skilled in the art in the light of the following description and accompanying drawings.

BRIEF SUMMARY OF THE INVENTION

In accordance with this invention, generally stated, an open top rotating vise for use in breaking joints in a drill string is provided which comprises a cradle having side plates and end plates, and semi-circular bearing surfaces carried by and extending outboard from the side plates. A stand comprises side frame members extending parallel to the cradle side plates, and carrying anti-friction rollers extending inboardly from the side frame members. The rollers are arranged on a radius concentric with the radius of the semi-circular bearing surfaces in position to engage the bearing surface. Jaws carried by the cradle slide intermediate the side plates. Preferably, two sets of jaws, facing one another, are powered toward and away from one another. The rollers are of the nature of cam followers, with needle or roller bearings, each with an inside race mounted on a heavy stub shaft threaded at its outer end to receive a nut to hold the assembled rollers in place. Power means, such as a hydraulic cylinder, rock the cradle about the center axis of the bearing surface and rollers, which is coincident with the axial center line of the drill string.

In operation, one end of a drill string section is clamped between jaws of a stationary vise adjacent the rotating vise. The section to be disengaged is clamped between the jaws of the rotating vise, and the rotating vise is given a turn in the uncoupling direction, through a short angle, just enough to break the joint. Because the threaded sections are tapered, rotation of one segment with respect to its connected segment through a small angle, generally less than 30 degrees, is enough to free the two sections.

BRIEF DESCRIPTION OF THE SEVERAL VIEWS OF THE DRAWINGS

In the drawings,

FIG. 9 is a view in side elevation of a side plate of the cradle;

FIG. 9A is a view in end elevation of the side plates shown in FIGS. 9 and 9B, showing a bearing surface welded to the side plate; and FIG. 9B is a view in side elevation of a side plate of the cradle opposite the side plate shown in FIG. 9.

DESCRIPTION OF THE PREFERRED EMBODIMENT

Figure 5:
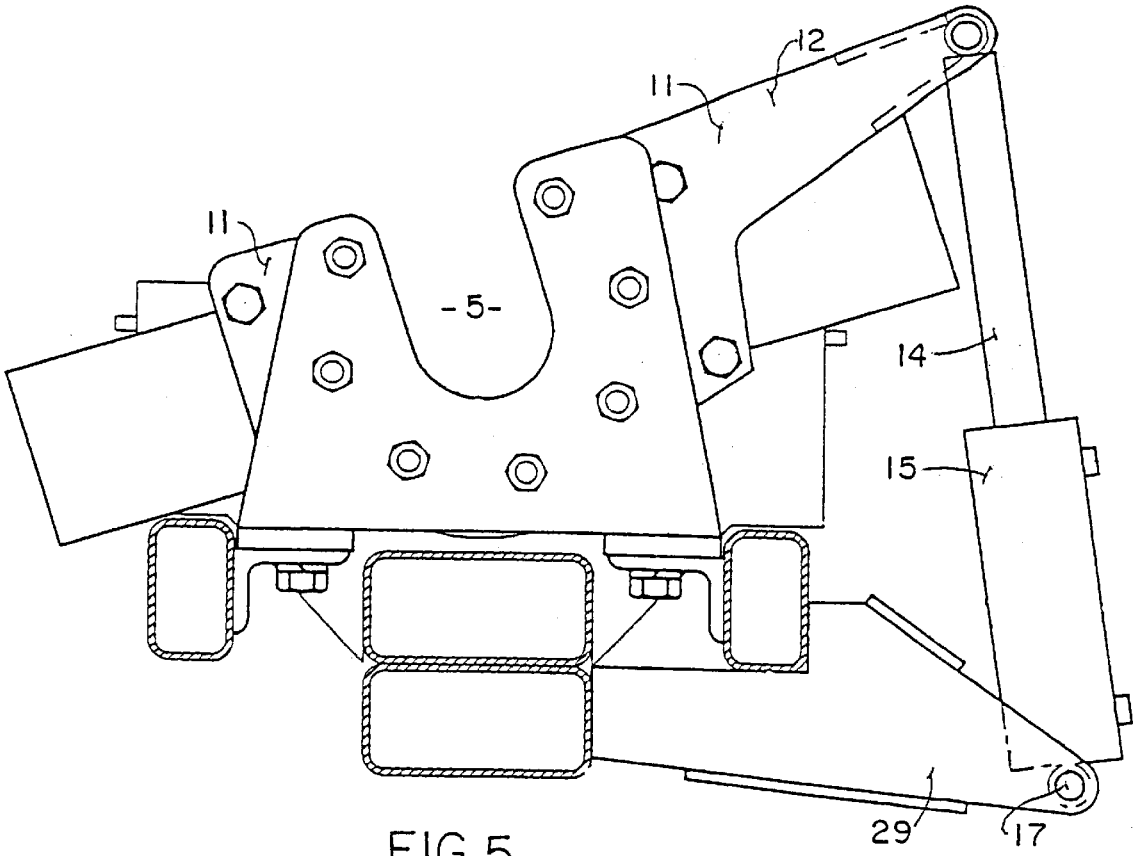
FIG. 5 is a view in side elevation, partly in section, showing the jaw operating mechanism, but without the jaws in place.
Figure 6:
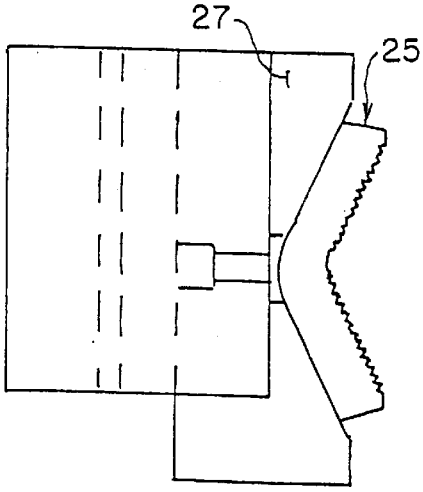
FIG. 6 is a view in side elevation of a jaw assembly.
Figure 6B:
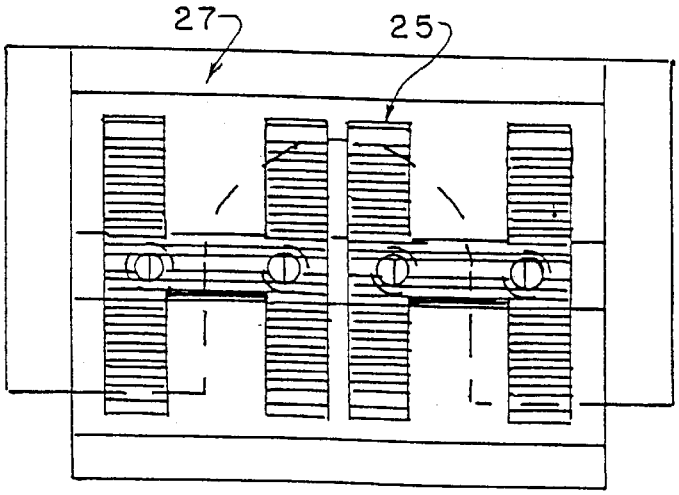
FIG. 6B is a view in front elevation of the jaw assembly of FIG. 6.
Figure 7A:
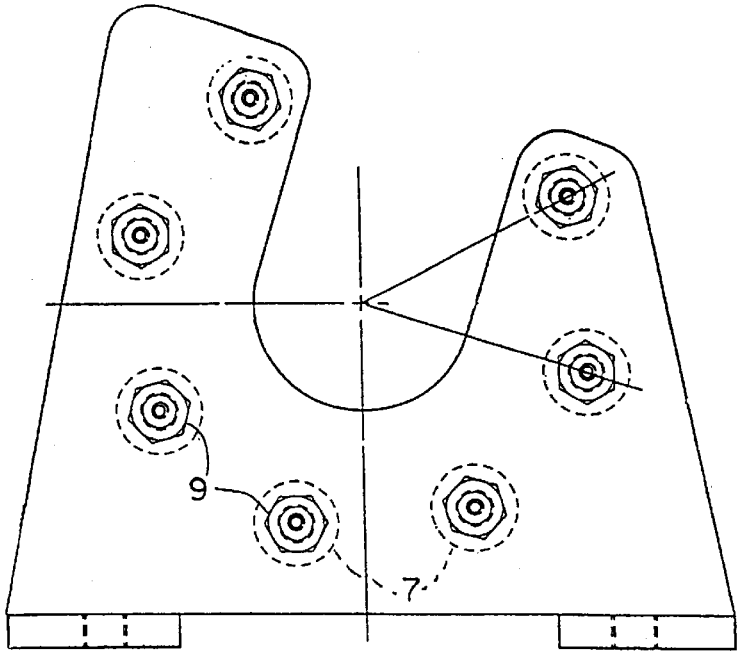
FIG. 7A is a view in side elevation of the support stand shown in FIG. 7.
Figure 6A:
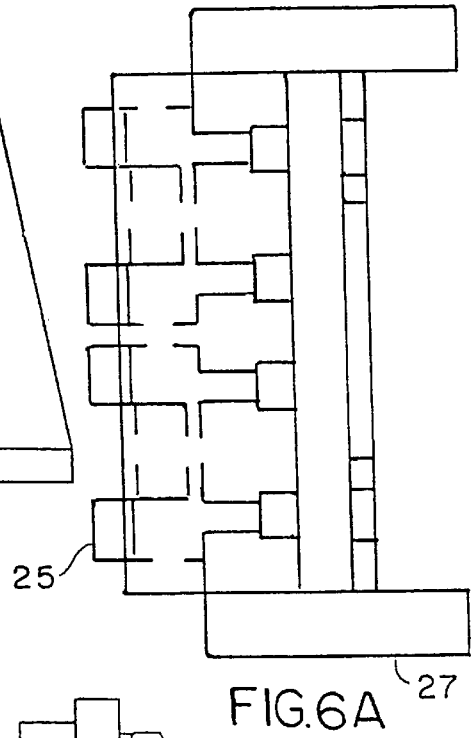
FIG. 6A is a top plan view of the jaw assembly.
Figure 7:
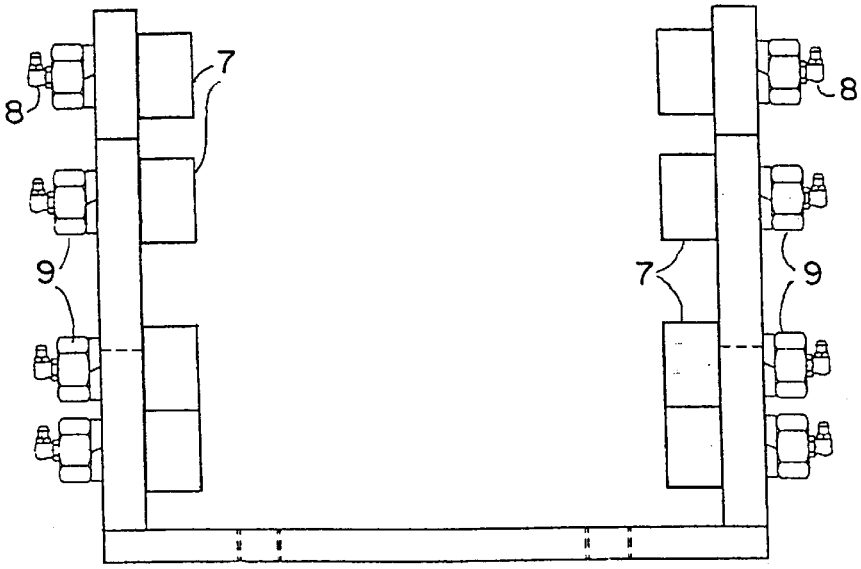
FIG. 7 is a view in end elevation of a support stand portion of the device.

Referring now to the drawings for one illustrative embodiment of rotating vise assembly of this invention, reference numeral 1 indicates the assembled device, mounted on a frame 2, in this embodiment, of a platform carried by a tracked or wheeled vehicle. The assembly includes a fixed support stand 3 with support stand mirror image side plates 4 bolted to the frame 2. The side plates have a U-shaped opening 5 as shown in FIG. 5, to receive a drill string section. Anti-friction rollers, which can be cam followers 7, are mounted on the side plates 4. The cam followers 7 extend inboardly of the side plates, with stub shafts extending through openings in the side plates and being bolted in place with heavy nuts 9. As is common with such cam followers, the stub shaft has an annular shoulder to space it from the side plate sufficiently to permit the roller to roll smoothly.

Figure 3:
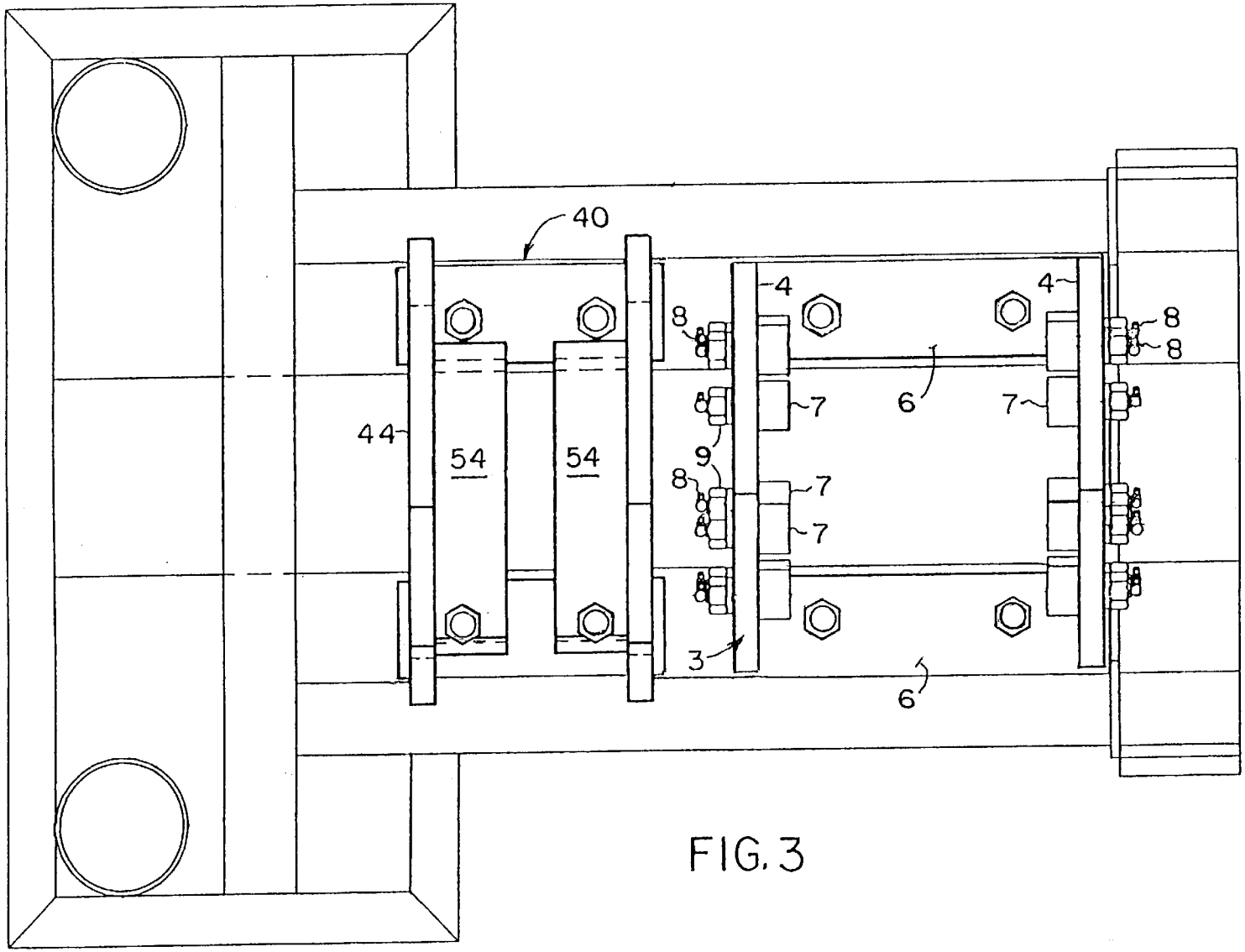
FIG. 3 is a top plan view of the device, without the jaw mechanism, and with a fixed vise frame in place.
Figure 3A:
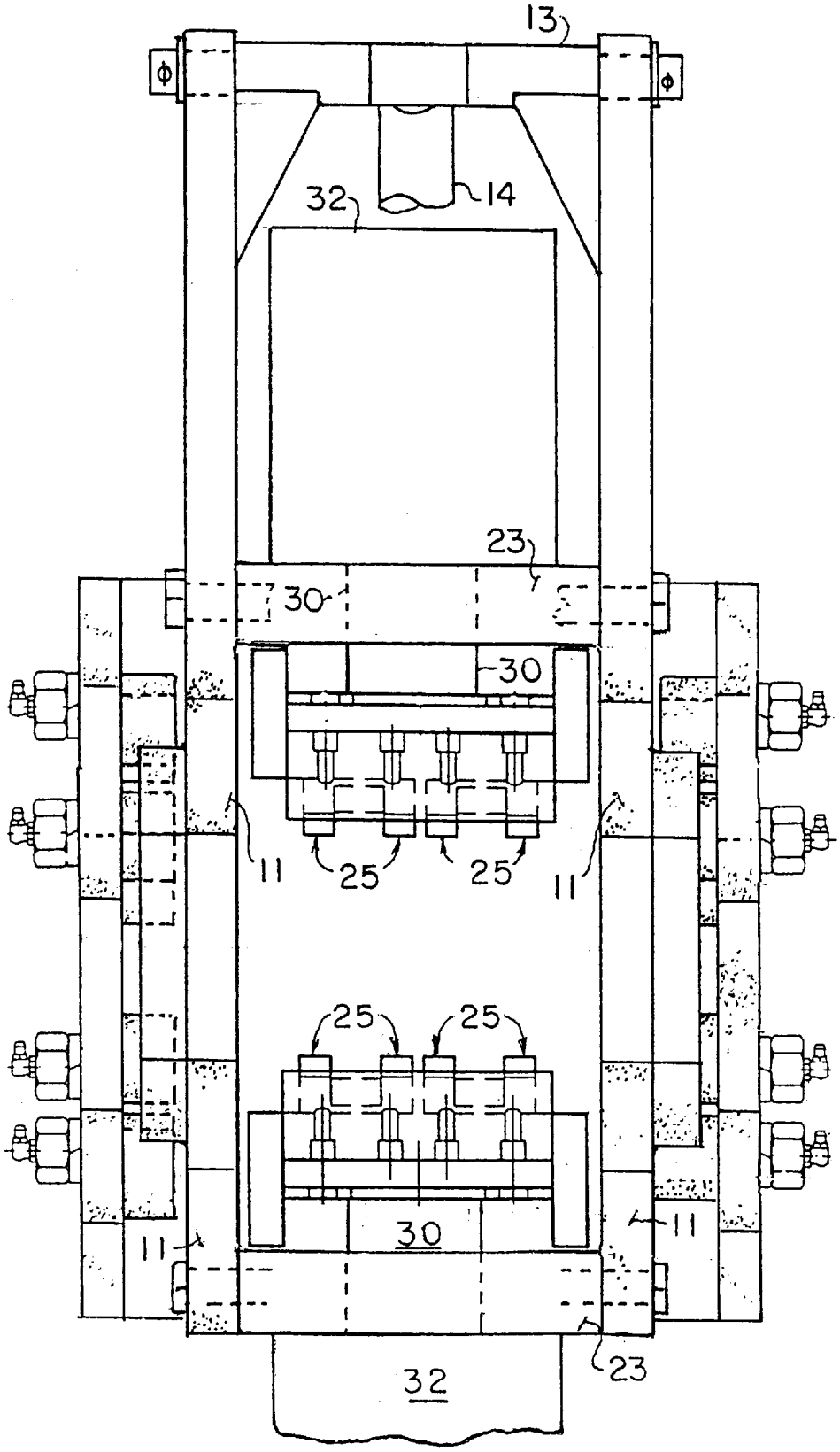
FIG. 3A is top plan view, partly fragmentary, showing the rotating vise with the jaws in place.
Figure 4:
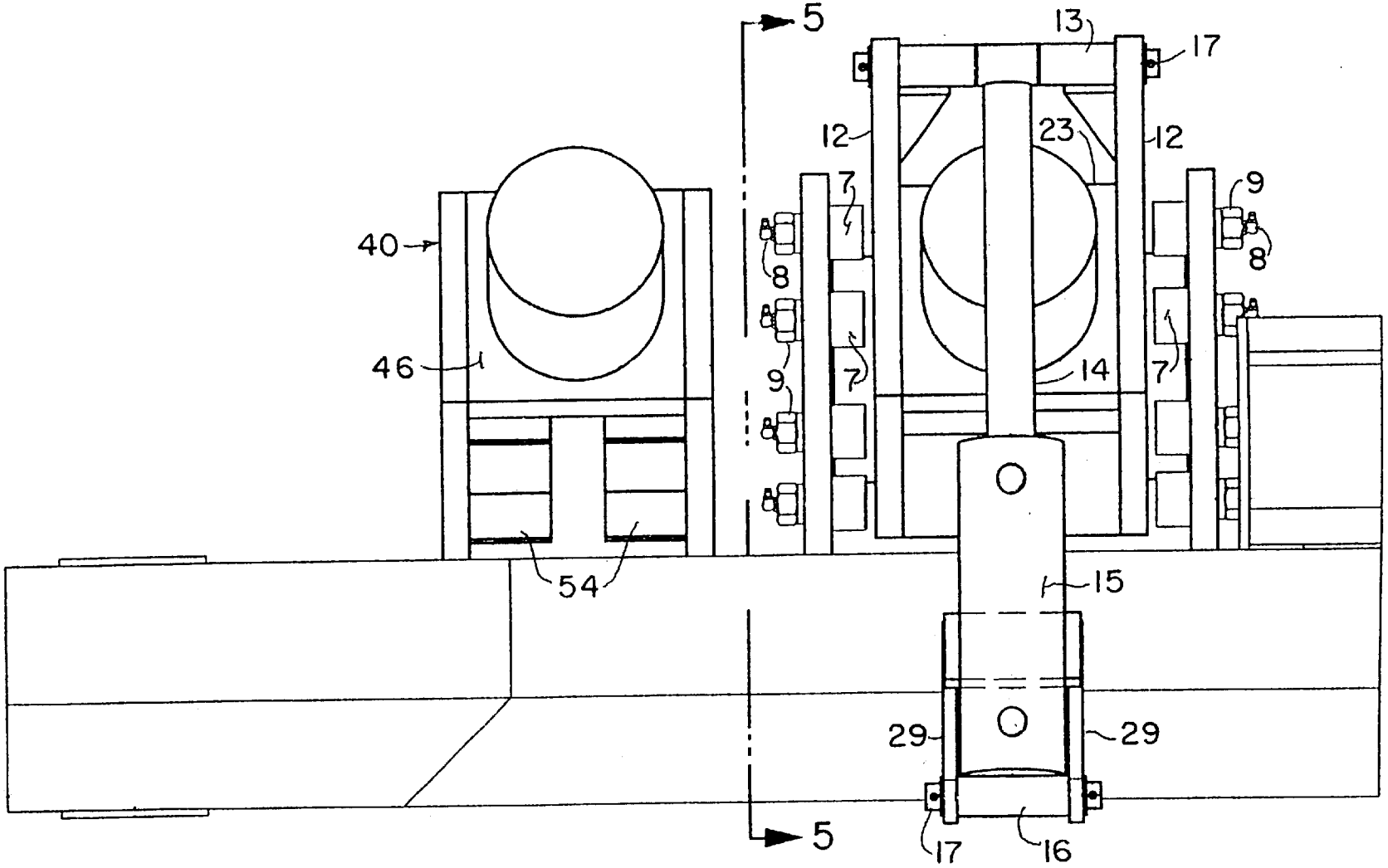
FIG. 4 is view in side elevation corresponding to the assembly of FIG. 3A.

As shown in FIGS. 3, 3A and 4, the cam followers are provided with grease fittings 8 at their outer ends, to permit the bearings to be lubricated.

A cradle 10 has cradle side plates 11. In this embodiment, lever extensions 12, integral with the side plates 11, are provided, between which a gudgeon 13 extends, to which a piston rod 14 is connected. The piston rod 14 is connected to a piston in a cylinder 15 that is pivotally mounted at its lower end on and between a pair of plates 29 fixedly mounted on the frame to which the rest of the device is mounted, on a sleeve 16 surrounding a pintle 17, as shown in FIGS. 4 and 5. The support side plates are welded to crossbars 6 which are, in turn, bolted to the platform carried by the vehicle, as shown in FIGS. 3 and 5.

Figure 8:
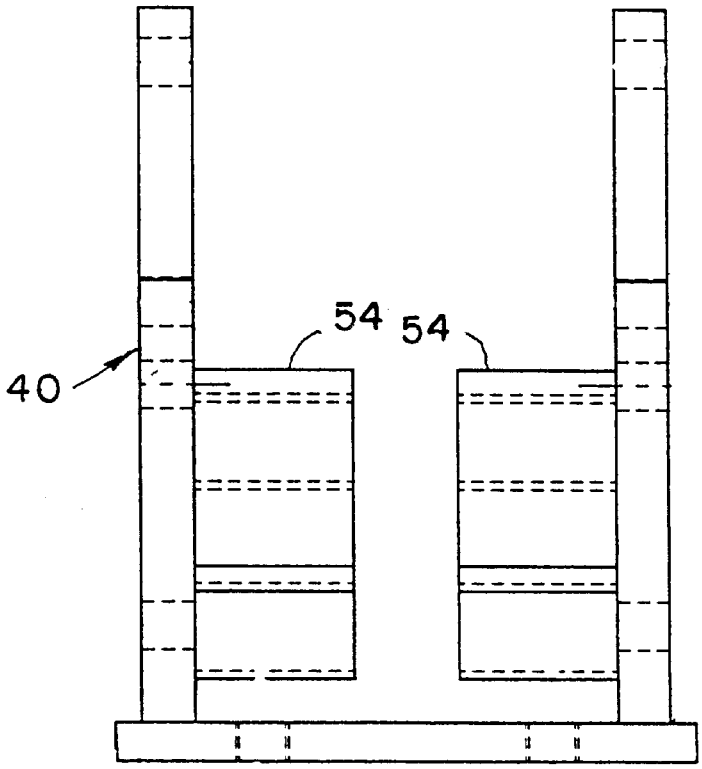
FIG. 8 is a view in end elevation of a support stand of a fixed vise.
Figure 8A:
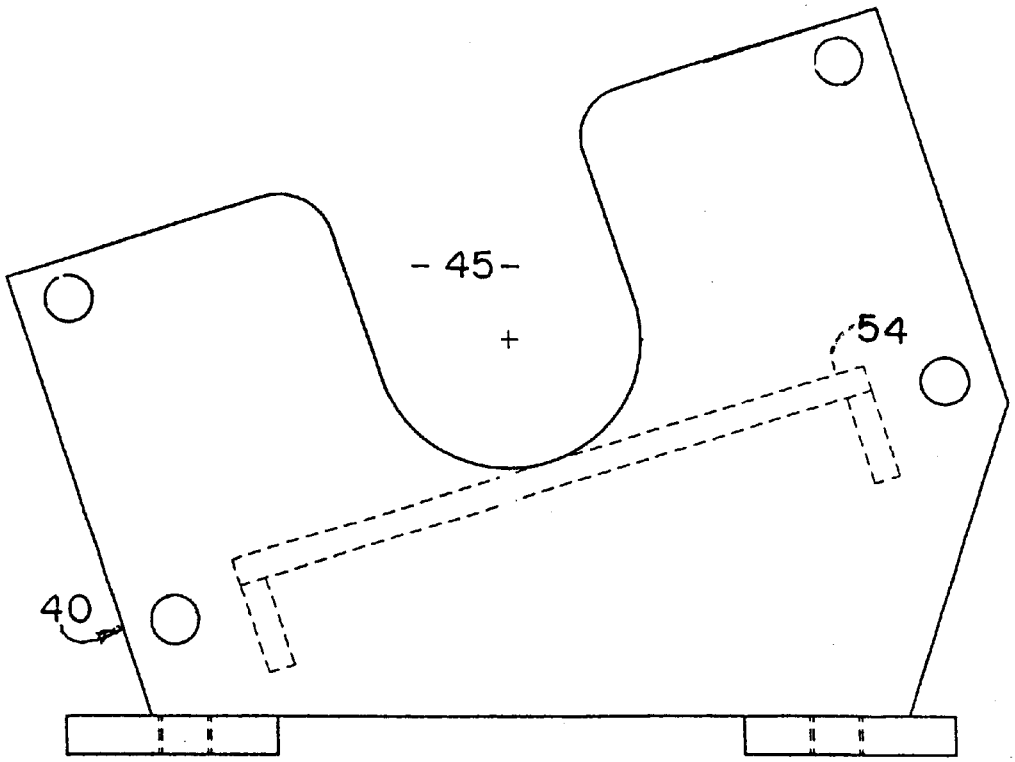
FIG. 8A is a view in side elevation of the stand shown in FIG. 8.
Figure 8C:
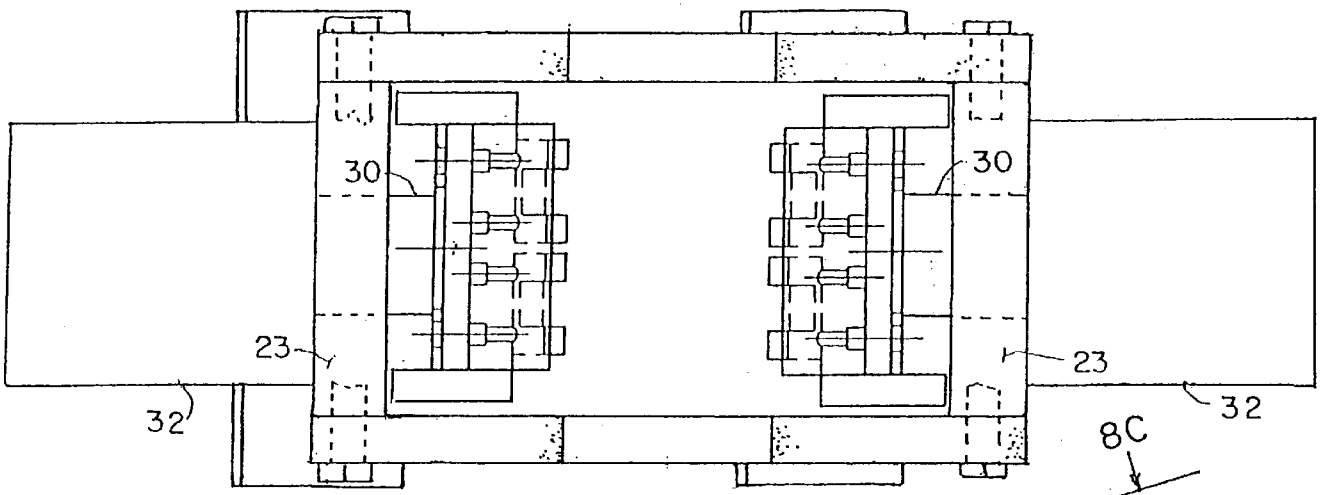
FIG. 8C is a top plan view of the fixed vise shown in FIG. 8B.

The sides plates 11 of the cradle are bolted to end plates 23, as shown particularly in FIGS. 3A and 8C; the end plates serve both as supports and as spacers.

Figure 1:
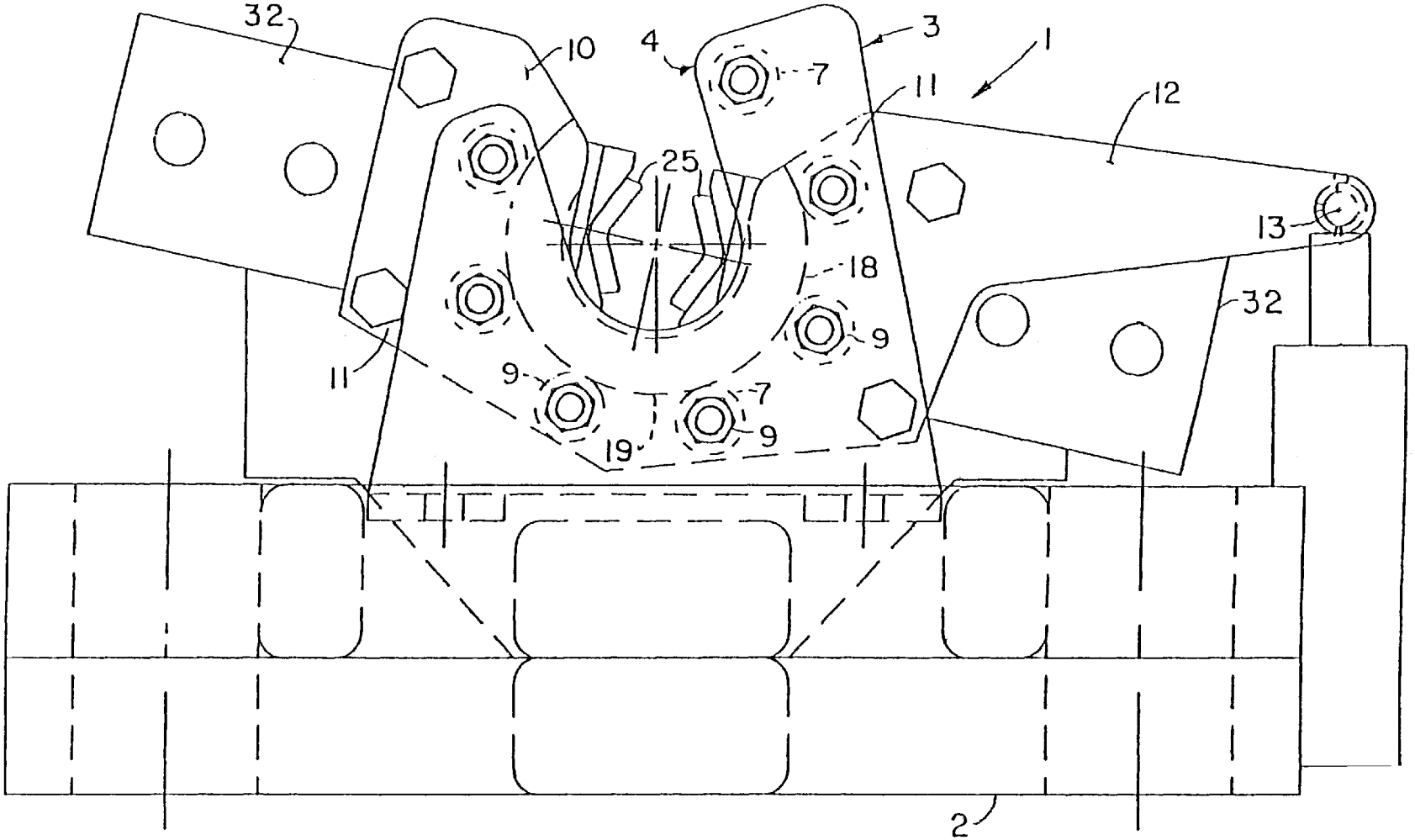
FIG. 1 is a view in side elevation of one embodiment of vise of this invention; with jaws in one angular position with respect to a heavy fixed frame of a platform or vehicle, shown in phantom lines, to which the device is secured.
Figure 2:
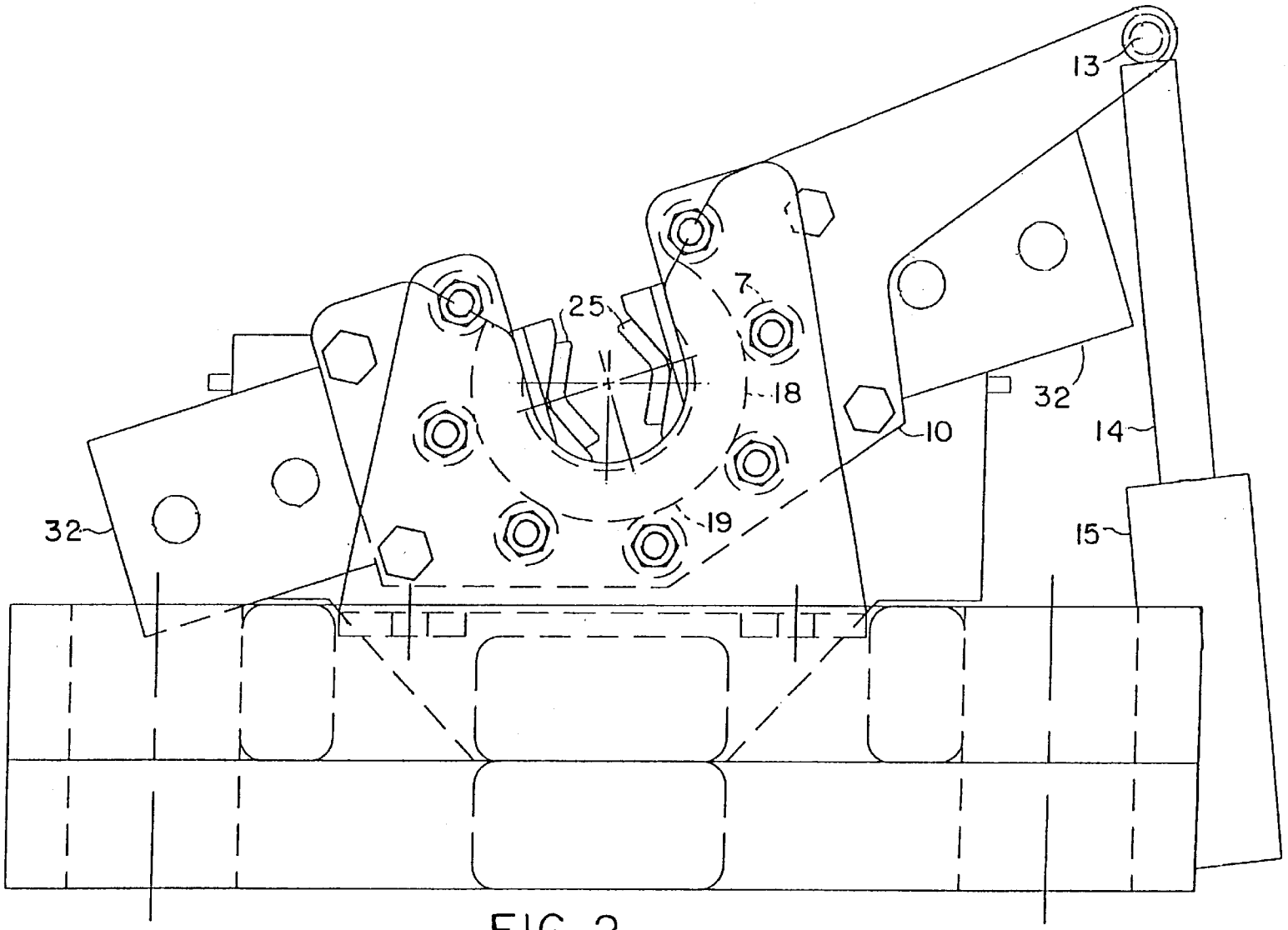
FIG. 2 is a view in side elevation, corresponding to the view in FIG. 1, but with the jaws in a second angular position.
Figure 8B:
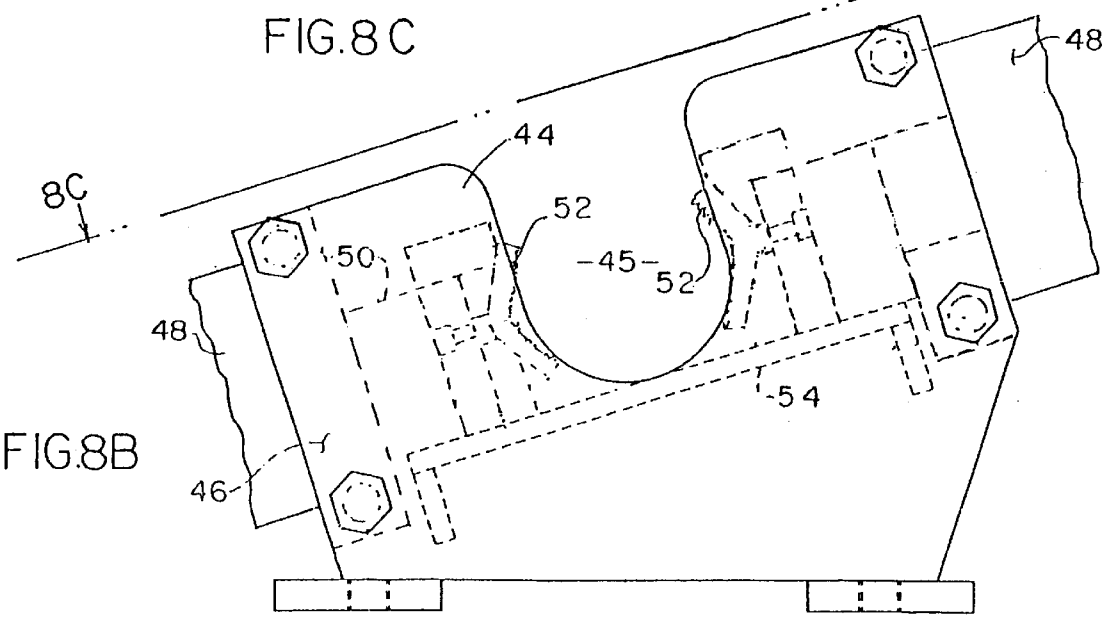
FIG. 8B is a view in side elevation, partly fragmentary, of the fixed vise.

Hydraulic cylinders 32 are mounted on an outboard face of the endplates 23. The endplates 23 have an opening to permit the passage of a piston rod 30 from each of the hydraulic cylinders 32. The piston rod 30 is connected to move a jaw assembly 25, supported below by slide channels 21, as illustrated in FIGS. 9, 9A and 9B. A somewhat modified slide channel 54, as applied to the fixed vise 40, is shown in FIGS. 8, 8A and 8B. The two jaw assemblies 25, face one another, as shown in FIGS. 1, 2 and 3A, and are moved toward and away from one another by the action of the hydraulic cylinders 32 and pistons 30. To that end, the hydraulic cylinders 32, like the hydraulic cylinder 15, are provided with the usual hydraulic fittings, and connected to a source of hydraulic fluid under pressure, not here shown.

As shown particularly in FIG. 9A, bearing surfaces 18 are provided, in this embodiment, in the form of the circumferential wall of heavy semi-circular plates 18 welded to the outboard surface of the cradle side plates. The outer surface 18 of the bearing surface plate is interruptedly circular, interrupted at the edges of a mouth of the U-shaped opening 20. The inner surface of the plate is shaped complementarily to the U-shaped opening. Although the pattern in which the cam followers are arranged and the arc of the bearing surfaces are sometimes referred to as semi-circular, the term is used to describe an interrupted circle, and not merely a half circle.

Referring now to FIGS. 3, 8, 8A, 8B and 8C, a fixed vise 40 has a pair of oppositely disposed side plates 44 with U-shaped openings 45, aligned with the U-shaped openings in the rotating vise side plates, and end plates 46, to which cylinders 32 are mounted, from which piston rods 50 extend, connected at their outer ends to jaw assemblies 52. The operation of the fixed vise is conventional. It serves to hold one end of a drill section tightly against rotation, while the end of the second section is gripped by the jaws 25 of the rotating vise and the cradle of the rotating vise is rotated around the axial center line of the drill sections.

It can be seen that the forces exerted by the jaws, both in their movement toward the string, and in the rotating movement, are transmitted to heavy sections of plate, backed by the rollers, which not only provide support, but provide smooth and easy movement of the cradle. Merely by way of example, the cradle and stand side walls can be 1-inch thick steel, with the bearing plate 19 projecting 1½ inch from the two side walls of the cradle, and the end plates of the cradle, 2 inches thick, in a cradle 30 inches long from the end of the lever arm 12 to the side of the end plate 23 most remote from the lever. The cam followers can be 2 inches in diameter, and spaced angularly 45 degrees from one another. In the embodiment shown, there are 7 cam followers, describing an arc of 315 degrees, on a radius of 5½ inches, and extending axially inboard of the side plates 1½ inches. The effective radius of the bearing surface 18 of the bearing plate 19 is, therefore, 4½ inches, because it touches each roller at a tangent 1 inch from the roller centerline. The rest of the elements of the device are sized proportionately.

Numerous variations in the construction of the device of this invention, within the scope of the appended claims, will occur to those skilled in the art in the light of the foregoing disclosure. Merely by way of example, one of the jaws of the vise can be made fixed, provided the diameter of the drill string section is known, and does not vary from one section or drill string to another. The advantage of the dual moveable jaws is that they will accommodate and center different sizes of pipe or rod. Sealed rollers, which do not need grease fittings, can be used, as suggested by the drawing figures in which no such fittings are shown. Although the rollers could be mounted on the outboard side of the cradle side plates, and a bearing surface provided on a radially inner side of a semi-circular plate, such an arrangement would be difficult, because the nuts on the stub shafts of the rollers would tend to be in the way of the jaws, and if grease fittings are provided, it would complicate matters even more. Other means for biasing the jaws toward one another can be used, including manually operated toggles (cf. U.S. Pat. No. 5,727,432) or motor-driven screws, but the hydraulic cylinders have the advantage of simplicity and versatility. The numbers and sizes of the rollers, and the sizes of the various other elements can be varied. The U-shaped openings are shown as slanted from the vertical. This is for convenience in loading and unloading, but the angle can be varied from vertical to a lesser angle than the one shown. The vise can be mounted on the vehicle frame itself, or on a separate frame or platform. The usual vehicle-mounted platform is capable of being swung to various angles with respect to the ground. The vise of this invention will operate in any angular position of the platform. The cradle of the vise of the present invention operates so smoothly and easily, that, given a suitable handle, the vise can be rotated manually to break a joint, but as a practical matter, because most of the operation of drilling rigs these days is mechanical or hydraulic, manual operation will seldom be used. These variations are merely illustrative.

Having thus described the invention, what is claimed and desired to be secured by Letters Patent is:

1. An open top rotating vise for use in breaking joints in a drill string, comprising a cradle comprising two side plates and two end plates, and semi-circular bearing surfaces carried by and extending outboard from said side plates; a stand comprising side frame members extending parallel to said cradle side plates, and anti-friction rollers carried by and extending inboardly from said stand side frame members, said rollers being arranged on a radius concentric with the radius of said cradle semi-circular bearing surface and positioned to engage said cradle bearing surface; means for rocking said cradle about the common center of said radii, and facing jaw members carried by said cradle intermediate said side plates and adapted to grip a drill string segment with said center coincident with a long axis of said drill string segment.

2. The vise of claim 1 including at least one cylinder mounted on an end plate, and a piston rod operated by said hydraulic cylinder and connected to move a jaw member toward a facing jaw member.

3. The vise of claim 2 wherein a hydraulic cylinder is mounted on each of the end plates, and both jaw members are moved toward one another in response to the introduction into said cylinders of hydraulic fluid.

4. The vise of claim 1 wherein the anti-friction rollers are cam followers.

5. The vise of claim 1 wherein the means for rocking said cradle is a hydraulic cylinder with a piston connected to a gudgeon mounted between lever arms integral with said cradle side plates.

6. An open top rotating vise for use in breaking joints in a drill string, comprising a cradle comprising a set of two, spaced, cradle side plates, and two, spaced, cradle end plates, and a stand comprising a set of two, spaced, stand side plates extending parallel to said cradle side plates, semi-circular bearing surfaces carried by and extending from the two side plates constituting one set of said cradle and stand side plates perpendicular to surfaces from which they project and extending toward the other set of said side plates; and anti-friction rollers carried by and extending from the other set of said side plates on an axis perpendicular to the surface from which they project, said rollers being arranged on a radius concentric with the radius of said semi-circular bearing surface and positioned to engage said bearing surface; means for rocking said cradle about the common center of said radii, and facing jaw members carried by said cradle intermediate said side plates and adapted to grip a drill string segment with said center coincident with a long axis of said drill string segment.

* * * * *

UNITED STATES PATENT AND TRADEMARK OFFICE

CERTIFICATE OF CORRECTION

PATENT NO. : 6,276,238 B1
DATED : August 21, 2001
INVENTOR(S) : Todd A. Junck and Richard S. Mongillo It is certified that error appears in the above-identified patent and that said Letters Patent is hereby corrected as shown below:

Title page,
Insert -- Assignee: Central Mine Equipment Co., Earth City, Missouri --

Signed and Sealed this

Ninth Day of April, 2002

*Attest:*

*Attesting Officer*

JAMES E. ROGAN
*Director of the United States Patent and Trademark Office*